United States Patent [19]

Engel

[11] 4,074,837

[45] Feb. 21, 1978

[54] AUTOMATICALLY OPERATING CASTING LADLE APPARATUS

[76] Inventor: Werner Engel, Ringstrasse 13, 3502 Vellmar 2, Germany

[21] Appl. No.: 750,930

[22] Filed: Dec. 15, 1976

[30] Foreign Application Priority Data

Dec. 15, 1975 Germany ..... 2556447

[51] Int. Cl.[2] ..... B22D 39/00

[52] U.S. Cl. ..... 222/629; 164/336; 222/357; 266/94

[58] Field of Search ..... 164/336; 222/356, 357, 222/358, 629; 266/92, 94

[56] References Cited

U.S. PATENT DOCUMENTS

| | | | |
|---|---|---|---|
| 548,925 | 10/1895 | Peirce | 222/629 X |
| 3,393,837 | 7/1968 | Takeshima | 222/629 |
| 3,514,018 | 5/1970 | Petig et al. | 222/629 |
| 3,774,815 | 11/1973 | McCarthy | 222/629 |

OTHER PUBLICATIONS 1,933,284 01001969 DT 222 629

*Primary Examiner*—Roy Lake
*Assistant Examiner*—Paul A. Bell
*Attorney, Agent, or Firm*—Sughrue, Rothwell, Mion, Zinn and Macpeak

[57] ABSTRACT

An automatically operating casting ladle apparatus for the scooping up and delivery of an exactly measured amount of molten metal to die-casting machines, casting molds, etc., in which an exact positioning of the casting ladle is ensured, on the one hand by control means regulating the depth and the angle of tilt of the ladle in the metal bath on filling, and on the other hand by a compensatory movement to ensure that the point of impact of the stream of molten metal remains fixed at each pouring. The control and drive units are, as far as possible, located outside the radiation range of the crucible, and they are otherwise protected against heat influence by surrounding casings.

10 Claims, 5 Drawing Figures

AUTOMATICALLY OPERATING CASTING LADLE APPARATUS

BACKGROUND OF THE INVENTION

The present invention relates to an automatically operating casting ladle apparatus for the delivery of a measured quantity of molten metal to die-casting machines, casting molds, etc., in which, on a swivel arm mounted on a fixed frame or similar element, there is provided, a pivotally mounted supporting arm carrying the casting ladle and kept in a constantly vertical position by an auxiliary means during the swiveling movements of the swivel arm, and a control linkage for tilting the ladle.

Known apparatuses of the type in question comprise a frame, across the top of which there is positioned a horizontal traverse bar, on which lies a sliding carriage which carries a structure which may be moved up and down and bears the casting ladle at its lower end.

In a further embodiment of a previously known apparatus, an arm rotatable through about 180° is mounted on a stand, and at its free end is pivotally mounted the vertically hanging supporting arm for the casting ladle, the supporting arm being held in a vertical position when the swivel arm is moved.

In these previously known apparatuses, sprocket chains ride over chain wheels are used, either to move the sliding carriage along the traverse bar or to hold the supporting arm of the ladle in a constantly vertical position while the swivel arm is moved. These drive chains or control chains have the essential disadvantage that, in particular due to their construction and as a result of being heated, they are subject to changes of length which are undesirable and uncontrollable, and thus also cannot be compensated for, so that on the one hand, the positioning of the casting ladle when pouring the molten metal into the pouring funnel of a machine or casting mold is no longer exact, and on the other hand the supporting arm of the casting ladle does not always take up exactly the same position on filling, which is the only guarantee that the amount of molten metal scooped up by the ladle is always the same. The heating of the chains, which are relatively easily subject to changes of length, results from their proximity to the crucible containing the molten metal, from which a considerable amount of heat is radiated. A further disadvantage of these machines is that numerous drive and control aggregates are arranged or mounted in such a way that every time the ladle scoops up a measured quantity of molten metal, they are moved over the crucible or into its vicinity, where they are exposed to intensive, direct heat radiation.

SUMMARY OF THE INVENTION

The object of this invention is to provide an automatically operating casting ladle apparatus of the type in question, in which the above mentioned disadvantages are avoided, so that by exact positioning of the ladle, on the one hand when pouring out the molten metal, and on the other hand when scooping up the molten metal, an exact and even dosage is obtained.

To solve this problem according to the invention, it is proposed to construct the apparatus in question in such a way that the swivel arm assembly comprises two parallel, lever arms of equal length, parallel to which lie a driving cylinder, which is arranged near to the frame, and one of the two control levers for the position of the casting ladle during the swiveling movement, whilst the second control lever, which is coupled at its upper end with the first control lever by means of an angular drive mechanism, runs parallel to the vertical supporting arm of the ladle, and is coupled at its lower end to the casting ladle.

In a preferred embodiment, the control linkage and gearing, as well as the drive units for moving the ladle when scooping up metal after being dipped into the metal bath and when pouring out the metal, are protected against excessive heat radiation by protective casings surrounding them. This results in high precision in the movements and positions, as well as a virtually trouble-free operation of the apparatus. It is of particular advantage if the drive units for moving the casting ladle are constructed independently of the remaining drive units for swiveling the arms which carry the ladle, since this makes it possible to swing the casting ladle out of its normal position into a position where it is possible to completely empty the casting ladle and the pouring lip, as well as, where appropriate, of an attached pouring spout, so that in this way, even the remaining metal normally still adhering to these elements can run out or drop thereoff.

It is furthermore of advantage to surround the casting ladle with a protective ring in relation to which the ladle pivots when scooping up molten metal. The purpose of such a protective ring is to hold back the impurities, slags, etc., floating on the surface of the metal bath, when the metal runs into the the ladle cavity. This is effected by the protective ring constructed according to the invention in such a manner that the ladle with its protective ring is dipped into the metal bath to the extent that the surface of the metal bath is approximately on a level with the middle of the protective ring, so that when the ladle is subsequently swung downwards to scoop up metal, its upper edge, over which the metal flows into the cavity of the ladle, is below the surface of the metal bath; thus the protective ring prevents impurities, slags, oxides, waste metal, etc., from the surface of the metal bath from floating into the ladle, and ensures that an exactly measured quantity of molten metal is taken up by the ladle.

Preferably the free edge of the pouring lip, by means of which the metal reaches the pouring funnel of the machine or mold, is immediately adjacent to the swivel axis of the casting ladle; since, however, this causes difficulties in many cases, the pouring lip must be of an appropriate length, with the result that the distance between the free edge of the pouring lip and the swivel axis of the ladle varies according to the length of the pouring lip itself. In consequence of this, the free edge of the pouring lip describes an arc when pouring out the metal, and the metal stream shifts. To compensate for this, so that the stream of metal always strikes approximately the center of the casting funnel, a slight upward and inward movement towards the column must be made when the ladle is emptied.

The pouring lip may be situated directly on the casting ladle, i.e. the ladle and the lip form one single part. In this case, the molten metal runs out of the ladle directly via the lip into the casting funnel of a machine, mold or similar element.

However, it is also possible to provide the casting ladle with a pouring spout hinged with the ladle, which comes to rest in a tilted position under the ladle when the latter is emptied, so that the molten metal in running out of the ladle runs first into the pouring spout and only then from the spout into the casting funnel of the die-casting machine or mold. This pouring spout can be attached to the protective ring and preferably lies approximately at right-angles to the protective ring of the ladle.

It is particularly expedient to construct the control linkage for moving the casting ladle in such a way that the piston of the drive cylinder, which is positioned at the top of the frame, is connected to a steering rod whose free end is hinged on a crankpin of the crown wheel of a bevel-gear transmission positioned at the upper end of the ladle supporting arm, so that from there, the steering movement is transmitted to the ladle, which is mounted to pivot about a horizontal axis, by means of a shaft laying in a protected position inside the inner space of the tubular supporting arm, and a bevel-gear transmission disposed at the lower end of the supporting arm.

Further features of the apparatus according to the invention will become apparent from the following detailed description, in conjunction with the accompanying drawings.

BRIEF DESCRIPTION OF THE DRAWINGS

FIG. 1 shows a side elevation of an automatically operating casting ladle apparatus of the type in question, constructed according to the invention, in a first embodiment;

FIG. 2 shows a side elevation of an apparatus in a second embodiment;

FIG. 3 shows a side view of the ladle of both embodiments when scooping up molten metal;

FIG. 4 shows the ladle when empty when,

FIG. 5 shows the casting ladle during the pouring of the metal into the pouring funnel of a die-casting machine.

DESCRIPTION OF PREFERRED EMBODIMENTS

Figure 1:
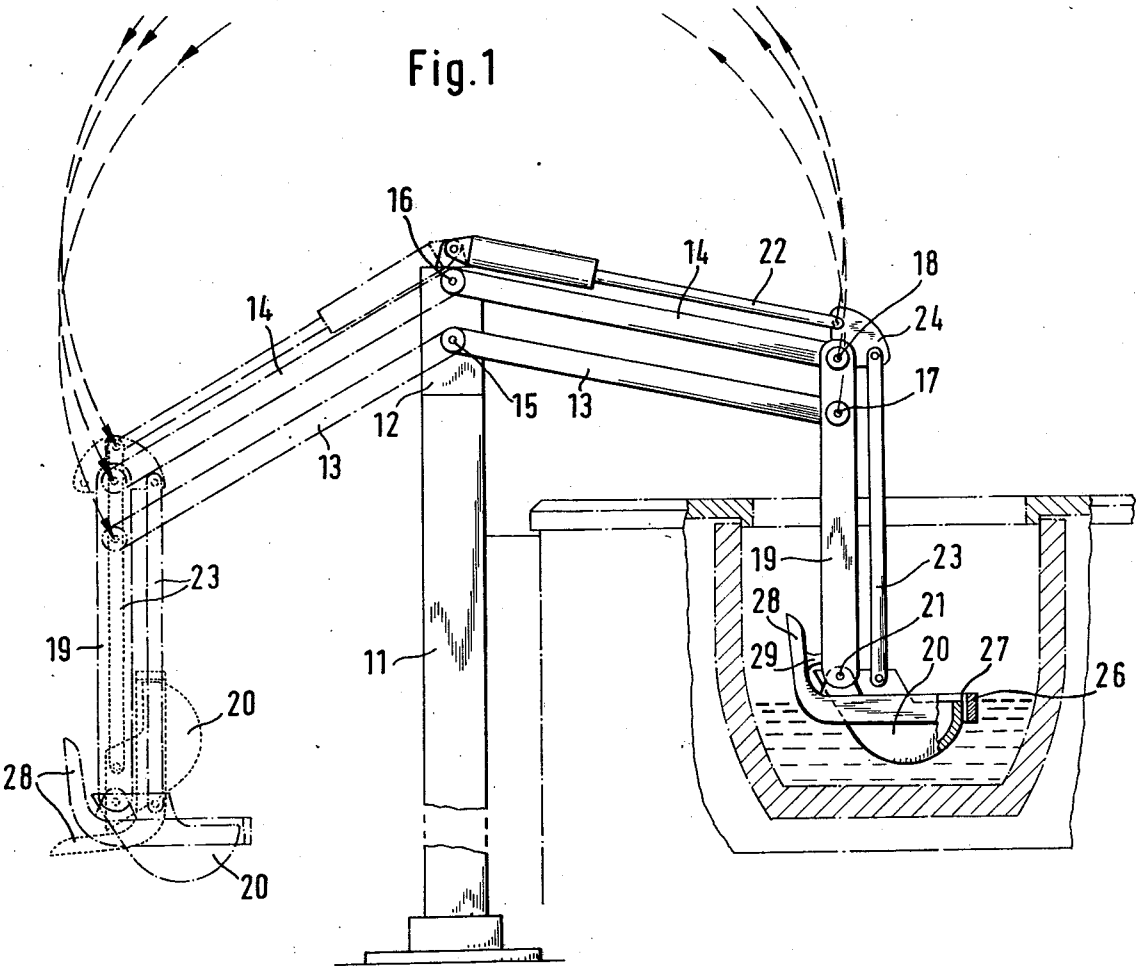
In FIGS. 1 to 5 of the drawings, the subject matter of the invention is shown in two preferred embodiments, which are described in detail below.

The apparatus according to the invention in one form, FIG. 1, comprises a column 11, at the head 12 of which, swivel arms 13 and 14 are pivotally mounted with one end on respective journal pins 15 and 16, in such a way that they can sweep across a range of at least 180° . Their other ends of the swivel arms 13, 14 are hinged by means of the journal pins 17 and 18 respectively to the upper end of the supporting arm 19, which, at its lower end carries the scooping and casting ladle 20. The latter is pivotally mounted on the axle 21 which rests on the supporting arm 19. In order to keep the casting ladle in a constantly horizontal position when the swivel arms 13, 14 are swung, and finally to be able to tilt it, a control linkage system or assembly consisting of control members or rods 22 and 23 is provided, which rods are coupled to one another by an angle lever 24 swivel-mounted on the journal pin 18. The control rod 22 is connected to the piston of a hydraulic or pneumatic drive cylinder 25, which maintains its position during the swiveling of the swivel arms 13, 14, so that by way of the control linkage members 22, 23, 24, the casting ladle 20, which is coupled to the lower end of the control rod 23, is maintained in its horizontal position.

The casting ladle 20 is surrounded by a protective ring 26, which has a horizontal inwardly-projecting stop 27, on which the upper edge of the casting ladle 20 abuts. Since in many cases the casting ladle cannot be placed directly above the inlet opening of the machines or molds, it must either have a sufficiently long pouring lip, or must be provided with a pouring spout. In this embodiment, the pouring spout 28 is integral with the protective ring 26 and rests by way of stop 29 against the supporting arm 19 of the ladle 20, so that when the casting ladle 20 is pivoted to scoop up metal by operation of the control linkage elements 22, 23, 24, the pouring spout 28 and the protective ring 26 maintain their position. For the purpose of emptying the casting ladle 20, the control linkage 22, 23, 24 is moved by operation of the hydraulic or pneumatic cylinder 25, and thus the ladle is swung upwards, counterclockwise about the axis 21, whereby, by means of the stop 27 on the protective ring 26, the latter is moved, together with the pouring spout 28, into the pouring position.

In this apparatus constructed according to the invention, all the essential driving members are positioned at the upper end of the column 11 and are thus outside the immediate radiation range of the metal bath and the crucible containing it, so that they are essentially removed from harmful heat influence. As a result of the exceptionally simple and practical embodiment of the control and operating elements for the casting ladle, these elements are also reliable and safe to operate, and render possible an exact dosage when scooping up molten metal as well as exact positioning when pouring the metal out of the casting ladle, i.e. pouring it into the funnel of the die-casting machine.

In some cases it is expedient to suspend the casting ladle electrically insulated from the linkage which carries it and controls its movement, so that it acts as an electrode for setting off a control impulse determining the depth to which the ladle is dipped into the metal bath. This means that, on making contact with the surface of the metal bath, the casting ladle triggers off a control impulse which can be delayed in an adjustable manner so as to cut off the dipping movement of the casting ladle into the metal bath after a predetermined time or after it has covered a predetermined distance. In addition, an adjustable stop is disposed on the control linkage for terminating the swivel movement of the ladle when scooping up metal, at a particular inclined position of the ladle to fix, the quantity of metal scooped up to a predetermined volume.

Figure 2:
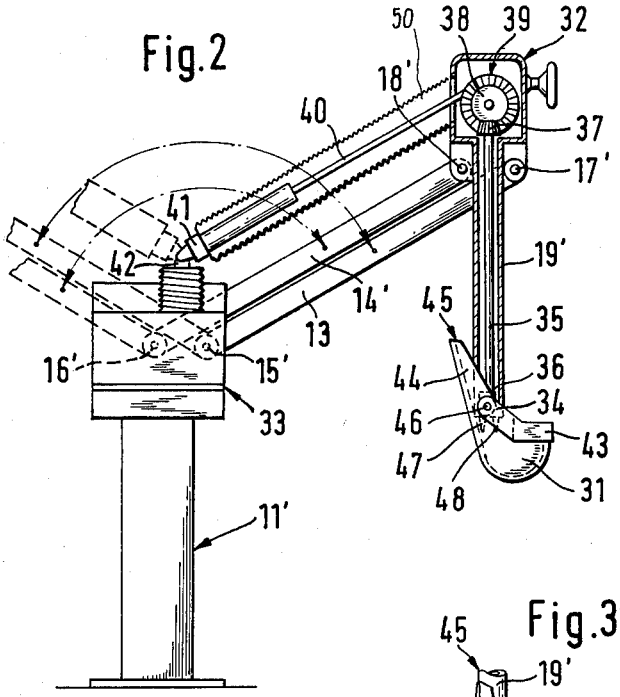
Figure 3:
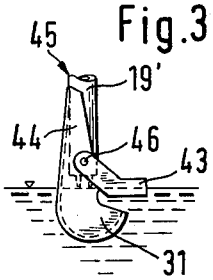
Figure 5:
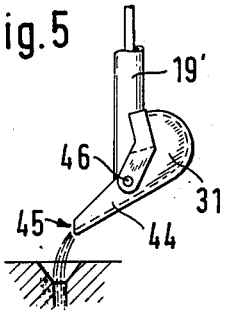
Figure 4:
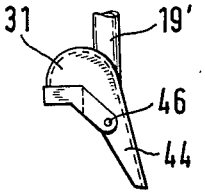

In the second embodiment of the apparatus constructed according to the invention wherein like elements been like primed numerals, FIG. 2, a housing 32 is positioned at the upper end of the tubular supporting arm 19' of the casting ladle 31, said housing supporting the journal pins 17', 18' for the free ends of respective swivel arms 13', 14'. The journal pins 15', 16' on which the opposite ends of the swivel arms 13', 14' are mounted, are disposed in a housing 33 which forms the head of the column 11' and in which the drive motor for the swivel arms 13', 14' is also placed. Connected to the casting ladle 31 is a bevel gear 34 which engages a bevel gear 36 resting on the control shaft 35 inside the tubular supporting arm 19'. At the upper end of the control shaft 35 is another bevel gear 37, which engages with the crown wheel 38 in the housing 32 and can be rotated within a certain sector by the steering rod 40 via a crankpin 39. The steering rod 40 is coupled to the hydraulic or pneumatic cylinder 41, which is attached at one end to a mounting member 42 on the housing 32. The cylinder 41 and the steering rod 40 are preferably encased in a bellows sheating 50 or the like, for protection against undesired heat absorption. The crown wheel 38 can be turned via the cylinder 41 and the steering rod 40, as desired so that by means of the control shaft 35 inside the supporting arm 19' and the bevel gears 36 and 37 at its two ends, the casting ladle can be swung into the required position as shown in FIGS. 3 to 5. The section of the casting ladle 31 which is lowered into the metal bath for filling, is likewise surrounded by a protective ring 43, which is mounted on the axis of the casting ladle 31 and maintains the position shown in FIGS. 2 and 3 while metal is being scooped up.

A separate pouring spout associated with the casting ladle is preferably used only in exceptional cases. The reason for this is that the spout itself does not reach the same temperature as the ladle, so that the molten metal flowing through the spout into the casting funnel of the machine or mold undergoes an undesired cooling. It is thus also advantageous for the casting ladle to have a long pouring lip 44 whose mouth 45 is at a relatively great distance from the swivel axis 46 of the ladle 31. It is true that with such a pouring lip, or with an appropriately-shaped pouring spout, awkwardly-placed casting funnels can be more easily reached, but they have the disadvantage that the stream of molten metal emitted from the lip or spout describes a changing arc while pouring, so that the point of impact of the metal stream moves during pouring. To offset this, the casting ladle has to effect a compensatory movement while pouring, in order that the point of impact of the stream of molten metal remains the same throughout.

The second embodiment has that advantage the all elements producing the drive or movement of the casting ladle are encased and protected from heat absorption.

It has been found particularly advantageous to dispose two electrodes 47, 48, made for instance of tungsten, graphite or some other suitable metal, at the lower end of the supporting arm 19', which, upon touching the surface when entering the metal bath, set off an electric control signal through which the dipping movement of the casting ladle is terminated.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In an automatically operating casting ladle apparatus for the delivery of a measured quantity of molten metal to a die-casting machine, mold or the like, and comprising:

a fixed frame, at least one swivel arm pivotably mounted at one end to said fixed frame, a supporting arm pivotably mounted at one end to the other end of said at least one swivel arm, a casting ladle mounted to the other end of said supporting arm, auxiliary means for keeping said casting ladle in a constant vertical position during swiveling movements of the swivel arm, and a control linkage mechanism for tilting the ladle, the improvement wherein:

said at least one swivel arm comprises two parallel, equal length lever arms, each lever arm being pivotably connected at one end to said fixed frame and extending in spaced parallel position with respect to each other and each being pivoted at their other end to said supporting arm, a drive cylinder disposed in the vicinity of said fixed frame, and said control linkage mechanism comprises a pair of control members, one of said control members lying parallel to said lever arms, being operatively connected at one end to a drive cylinder and being operatively connected at its opposite end to one end of the second control member and extending parallel to the supporting arm for said ladle and being operatively coupled at its end remote from said first control member, to said casting ladle.

2. The apparatus according to claim 1, further comprising protective covering for said control members and said drive cylinder.

3. The apparatus according to claim 2, wherein said first and second control members are interconnected by a crank gear and a bevel gear respectively, and said second control member is interconnected with said ladle by means of a

4. The apparatus according to claim 1, further comprising a protective ring member at least surrounding said ladle and pivotably mounted thereto to permit the ladle to be pivoted downwardly with respect to the ring member for scooping up liquid metal.

5. The apparatus according to claim 4, wherein said casting ladle comprises a pouring lip whose mouth is remote from the pivot axis of said ladle.

6. The apparatus according to claim 4, further comprising a pouring spout disposed on said protective ring member and operatively positioned with respect to the ladle so as to occupy a tilted position in front of and under said ladle when said ladle is shifted by said control linkage mechanism to pouring positions.

7. The apparatus according to claim 5, further comprising means to effect compensatory movement of said ladle to maintain a constant point of impact of the stream of molten metal as it is discharged from the casting ladle during pivoting of the same.

8. The apparatus according to claim 1, further comprising electrode means carried by said casting ladle and positioned with respect to the ladle so as to measure the depth to which the ladle is dipped into the metal bath by contact with said molten metal.

9. The apparatus according to claim 8, wherein said electrodes are formed of one material of the group consisting of graphite and tungsten and are disposed on the second control member at the end which is operatively connected to said ladle

10. The apparatus according to claim 1, further comprising an adjustable stop carried by said ladle for limiting the tilt position of the ladle when taking up a measured quantity of metal.

* * * * *